US011975748B2

(12) United States Patent
Andreev

(10) Patent No.: US 11,975,748 B2
(45) Date of Patent: May 7, 2024

(54) SIDE BEARING

(71) Applicant: Aleksandr Aleksandrovich Andreev, Moscow (RU)

(72) Inventor: Aleksandr Aleksandrovich Andreev, Moscow (RU)

( * ) Notice: Subject to any disclaimer, the term of this patent is extended or adjusted under 35 U.S.C. 154(b) by 727 days.

(21) Appl. No.: 17/272,491

(22) PCT Filed: Nov. 22, 2019

(86) PCT No.: PCT/RU2019/050193
§ 371 (c)(1),
(2) Date: Mar. 1, 2021

(87) PCT Pub. No.: WO2020/050753
PCT Pub. Date: Mar. 12, 2020

(65) Prior Publication Data

US 2021/0324910 A1 Oct. 21, 2021

(30) Foreign Application Priority Data

Sep. 4, 2018 (RU) ..... 2018131695

(51) Int. Cl.
*B61F 5/14* (2006.01)

(52) U.S. Cl.
CPC ..... *B61F 5/14* (2013.01); *B61F 5/142* (2013.01)

(58) Field of Classification Search
CPC ..... B61F 5/142; B61F 5/14
See application file for complete search history.

(56) References Cited

U.S. PATENT DOCUMENTS 3,735,711 A * 5/1973 Hassenauer ..... B61F 5/142 267/3
4,998,997 A * 3/1991 Carlston ..... B61F 5/142 267/141.1
5,601,031 A * 2/1997 Carlson ..... F16F 1/426 267/3
6,092,470 A * 7/2000 O'Donnell ..... B61F 5/142 384/423

(Continued)

FOREIGN PATENT DOCUMENTS

CA 2760813 A1 * 11/2010 ..... B61F 5/142
RU 2698261 C1 * 8/2019 ..... B61F 5/14
RU 2701139 C1 * 9/2019

*Primary Examiner* — Scott A Browne
(74) *Attorney, Agent, or Firm* — Nadya Reingand

(57) ABSTRACT

A side bearing for freight bogies of railway transport comprising a base, a plate, a cap, and a resilient element. The base has an annular protruding element, a centering protruding element, and two lateral protruding elements. The lateral protruding elements have J-shaped recesses. The plate has an annular protruding element with lugs, and an aperture for receiving the cap. The cap has an annular protruding element and a centering protruding element. A central opening is provided in the body of the resilient element for positioning on the protruding elements of the base and cap. The annular protruding element of the plate is telescopically mounted inside the annular protruding element of the base, and the cap is mounted inside the aperture of the plate. The lugs of the annular protruding element snap into the J-shaped recesses of the lateral protruding elements.

1 Claim, 5 Drawing Sheets

(56) References Cited

U.S. PATENT DOCUMENTS

| | | | | |
|---|---|---|---|---|
| 7,503,264 | B2 * | 3/2009 | Mitchell | B61F 5/142 105/199.3 |
| 7,802,524 | B1 * | 9/2010 | Gregar | B61F 5/142 384/423 |
| 8,356,558 | B2 * | 1/2013 | Jeambey | B61F 5/14 105/199.3 |
| 8,939,087 | B2 * | 1/2015 | McKisic | B61F 15/20 105/199.3 |
| 8,967,052 | B2 * | 3/2015 | Aspengren | B61F 5/142 105/199.3 |
| 11,613,281 | B2 * | 3/2023 | Harris | B61F 5/142 105/193 |
| 2012/0291660 | A1 * | 11/2012 | Aspengen | B61F 5/142 105/199.3 |
| 2013/0145956 | A1 * | 6/2013 | Sammartino | B61F 5/142 105/199.3 |
| 2013/0327246 | A1 | 12/2013 | Aspengren et al. | |

* cited by examiner

SIDE BEARING

TECHNICAL FIELD OF THE INVENTION

The invention relates to railway transport and, particularly, to side bearings of freight bogies.

BACKGROUND OF THE INVENTION

RU 2415041 C1 discloses a side bearing comprising: a base having an annular protrusion and a guiding protrusion; an upper plate having an annular protrusion, the upper plate being arranged above the base, telescopically connected to the annular protrusion of the base and having a flat surface to interact with a car body; a central protrusion arranged on a lower surface of the upper plate; a friction liner having a central through hole, the friction liner being arranged between the base and the upper plate such that it is adapted to press the latter to some part of the car body; a heat insulator made of a polyester material with a glass filler having a low heat conductivity and a high impact strength, the heat insulator being arranged between the upper surface of the friction liner and the lower surface of the upper plate, and the heat insulator having open-top cavities and a built-in part configured to accommodate and grip one end section of the friction liner; and an additional heat insulator arranged between the lower surface of the friction liner and the base. The main and additional heat insulators are configured such that the ratio of the thickness of the additional heat insulator to the thickness of the main heat insulator is 1:4-1:2. Furthermore, the guiding protrusion of the base is configured to grip and accommodate another end section of the friction liner to forcedly fix the position of the main heat insulator and the friction liner relative to each other.

The main drawbacks of the side bearing disclosed in RU 2415041 C1 are as follows: the side bearing cannot be delivered in a fully assembled state; the impossibility of providing a pre-loaded force in the state of installation height during the side-bearing delivering; the side bearing can be unpredictably disassembled when a freight car moves through turns, as well as when the freight car turns around its longitudinal axis during its unloading.

RU 2646213 C1 discloses a side bearing comprising a housing having a wall structure, a cover, and an elastically deformable element. The cover is mounted such that it is adapted to perform a substantially coaxial movement relative to the housing. The cover has a substantially flat surface with a wall structure extending therefrom. The elastically deformable element is arranged in a cavity formed by the housing and the cover in their working combination. The elastically deformable element has a central through hole arranged along the direction of its compression. The flat surface of the cover and the base of the housing are provided with guides arranged in the central through hole of the elastically deformable element. The free end parts of the guides have a convex shape relative to the outer surface of the guides.

The main drawback of the side bearing disclosed in RU 2646213 C1 is as follows: the impossibility of providing a pre-loaded force in the state of installation height during the side-bearing delivering.

RU 2646213 C1 discloses a side bearing comprising: a base having an annular protrusion and a guiding protrusion; a cover arranged above the base and having an annular protrusion, the cover being telescopically connected to the annular protrusion of the base and having a flat surface to interact with a car body; a central protrusion arranged on a lower surface of the cover; an elastic-element unit having a central through hole, the unit being arranged between the base and an upper plate such that it is adapted to press the latter to some part of the car body, the unit being arranged coaxially relative to the guiding protrusion of the base and the central protrusion on the lower surface of the cover, and the unit consisting of two elastic elements of different rigidity which are separated by the plate. The annular protrusion of the base is arranged inside the annular protrusion of the cover. The cover has two J-shaped slots on the annular protrusion. In each of the J-shaped slots, a protrusion formed on the outer surface of the annular protrusion of housing is provided such that, when assembled, the protrusions formed on the outer surface of the annular protrusion of the housing abut on the inner lower surface of each of the J-shaped slots formed on the annular protrusion of the base. The J-shaped slot has a profile that allows the protrusion formed on the outer surface of the annular protrusion of the housing to move inside an upper horizontal part of the J-like slot in the complete compression state of the side bearing, when the lower surface of the cover abuts on the upper end of the annular protrusion of the base. The lower point of the protrusion formed on the outer surface of the annular protrusion of the housing is arranged above the upper point of an vertical protrusion of the J-shaped slot formed on the annular protrusion of the base, thereby allowing the side bearing to be assembled and disassembled but retaining the possibility of unpredictable disassembly when the cover is rotated relative to the base along an axis perpendicular to the base.

The main drawbacks of the side bearing disclosed in RU 2646213 C1 are as follows: the impossibility of preventing the side bearing from being unpredictably disassembled when a freight car moves through turns and the freight car turns around its longitudinal axis during the freight-car unloading.

SUMMARY OF THE INVENTION

The technical result obtained when implementing the present invention consists in constraining the vertical movements of a cover of a side bearing, providing the possibility of heat insulation between an elastically deformable elastomeric element and the cover which is heated due to its friction against a car body and is in constant contact with the car body, and preventing the side bearing from being unpredictably disassembled when a freight car moves through turns and the freight car turns around its longitudinal axis during the freight-car unloading.

The above-indicated technical result is achieved by using a side bearing comprising: a base having an annular protrusion, a centering protrusion and two lateral protruding parts; a plate arranged above the base and having an annular protrusion, the plate being telescopically connected to the annular protrusion of the base and having a hole in an upper part of the plate, the hole being made with a gap from an inner surface of the annular protrusion of the plate; a cover having a cylindrical or conical shape with a flat upper surface to interact with a car body, an annular protrusion in a lower part and a centering protrusion on a flat lower surface, the cover being arranged inside the plate with the annular protrusion such that an inner lower horizontal surface of the plate is in contact with the upper surface of the annular radial protrusion of the cover; an elastically deformable elastomeric element arranged in a cavity formed by the base with the annular protrusion, the plate with the annular protrusion and the cover in their working assembly, the elastically deformable elastomeric element having a central through hole provided along a direction of its compression. The centering protrusion of the base and the centering protrusion of the plate are arranged in the central through hole of the elastically deformable elastomeric element. Each lateral protruding part of the annular protrusion of the base is provided with one J-shaped recess including a vertical through recess, a horizontal sectoral recess and a vertical constraining recess. The vertical through recess has two vertical constraining surfaces. The vertical constraining recess has a stop surface in the upper part and two vertical constraining surfaces. The plate is formed on the outer surface of the annular protrusion in the lower part and has two guiding protrusions, each of which is provided with two vertical constraining surfaces and a stop surface in the upper part. The stop surface of each of the guiding protrusions on the annular protrusion of the plate interacts with the stop surface of the corresponding vertical constraining recesses in the annular protrusion of the base. There is a technological gap between the vertical constraining surfaces of each of the guiding protrusions on the annular protrusion of the plate and the vertical constraining surfaces of the corresponding vertical constraining recess in the annular protrusion of the base. When the side bearing is in a complete closure state, an extreme upper point of the guiding protrusion on the annular protrusion of the plate is arranged above an extreme upper point of the horizontal sectoral recess, thereby eliminating the possibility of rotating the plate relative to the base and preventing the side bearing from being spontaneously disassembled.

BRIEF DESCRIPTION OF THE DRAWINGS

The invention is illustrated in the drawings, in which.

DETAILED DESCRIPTION OF THE INVENTION

Figure 1:
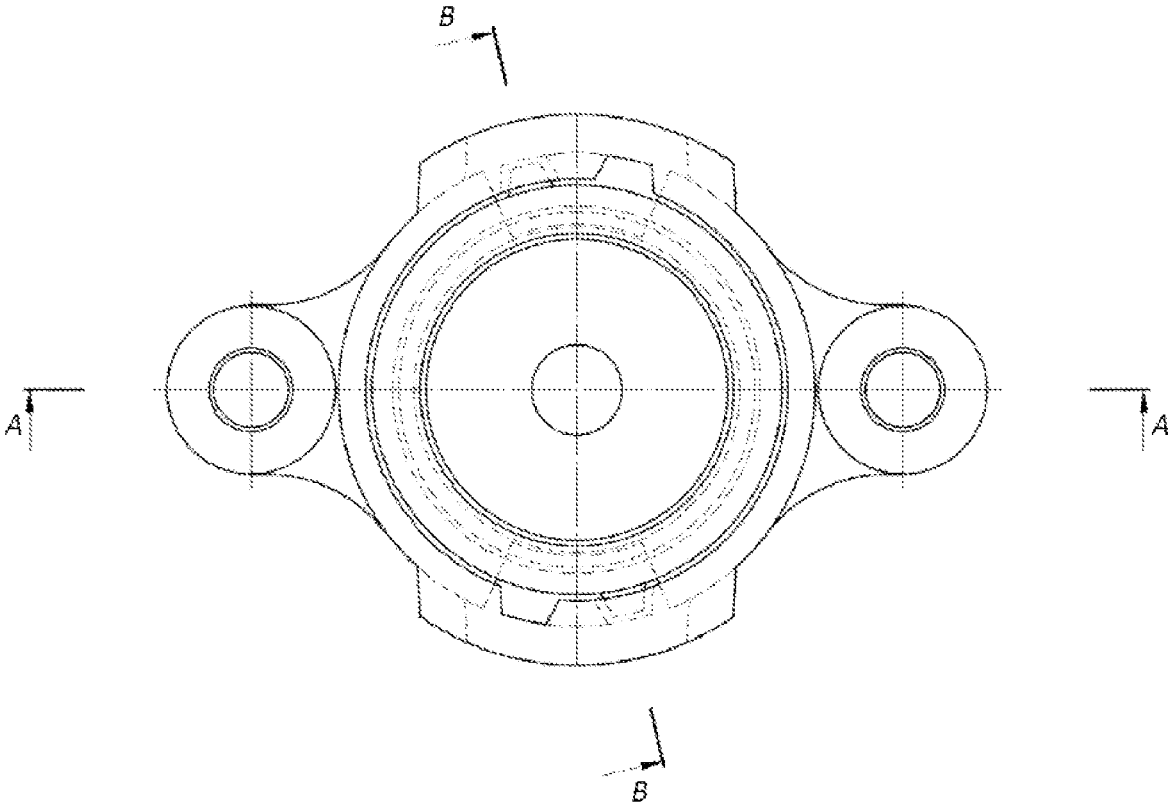
FIG. 1 shows a side bearing.
Figure 2:
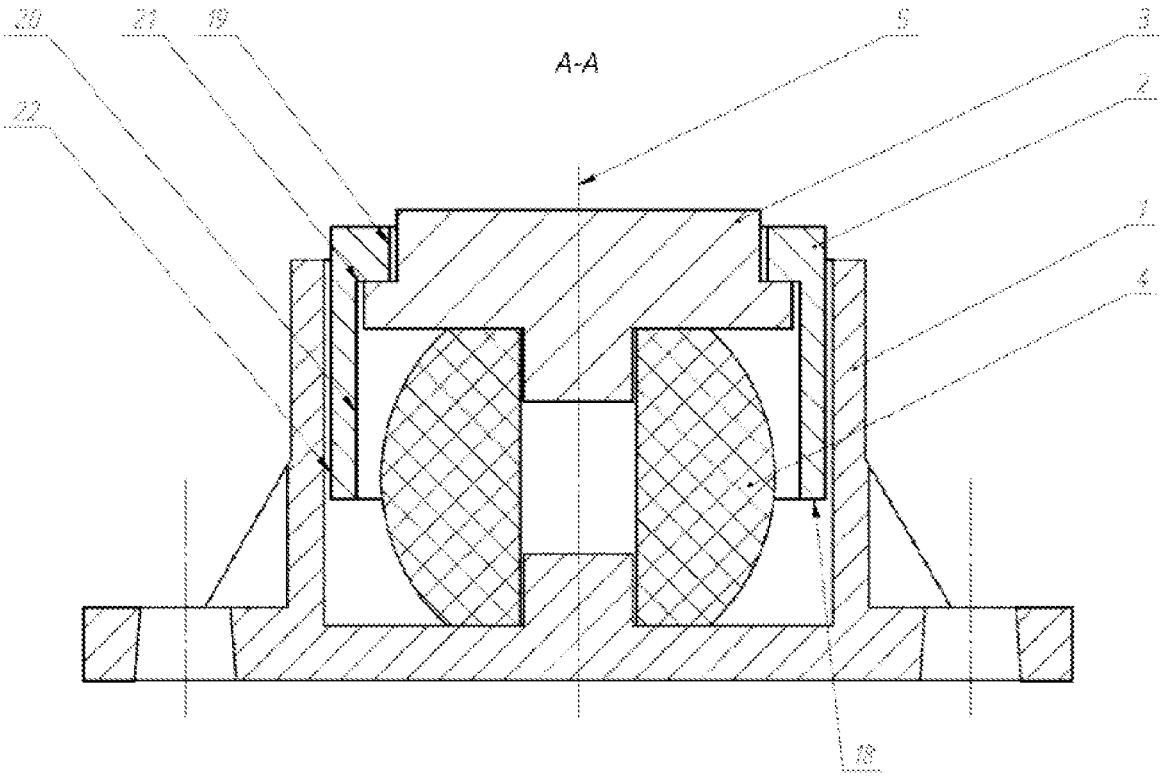
FIG. 2 shows a section taken along line A-A in FIG. 1.
Figure 3:
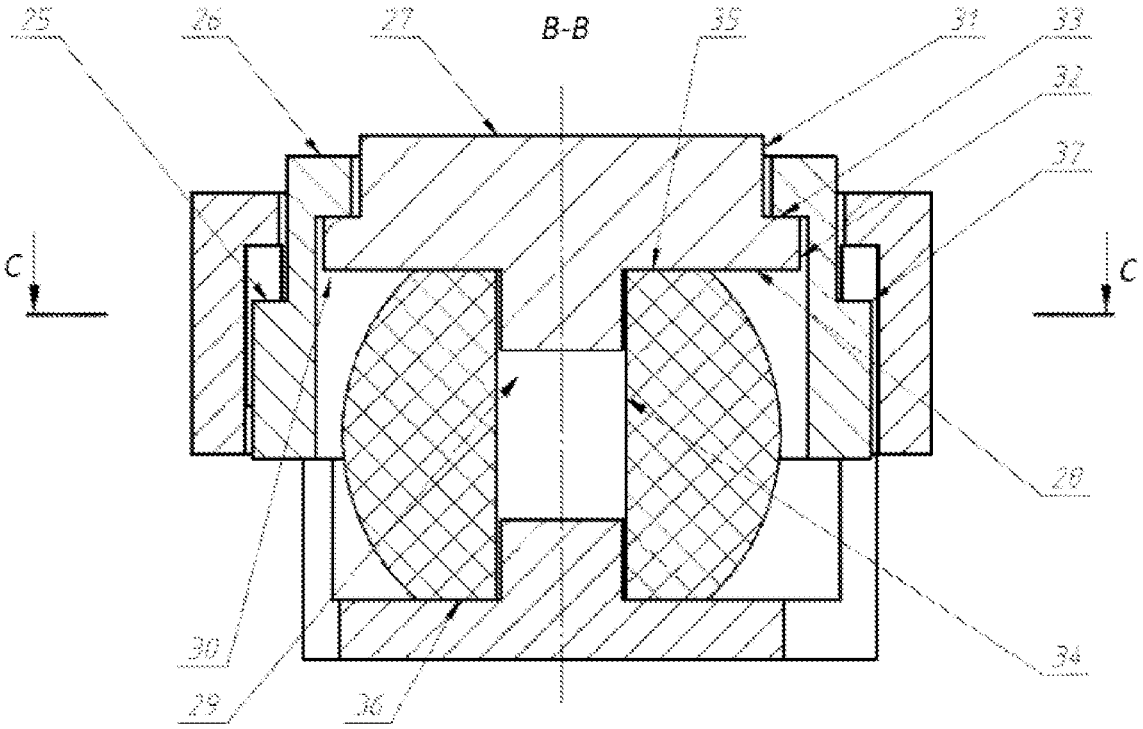
FIG. 3 shows a section taken along line B-B in FIG. 1.
Figure 4:
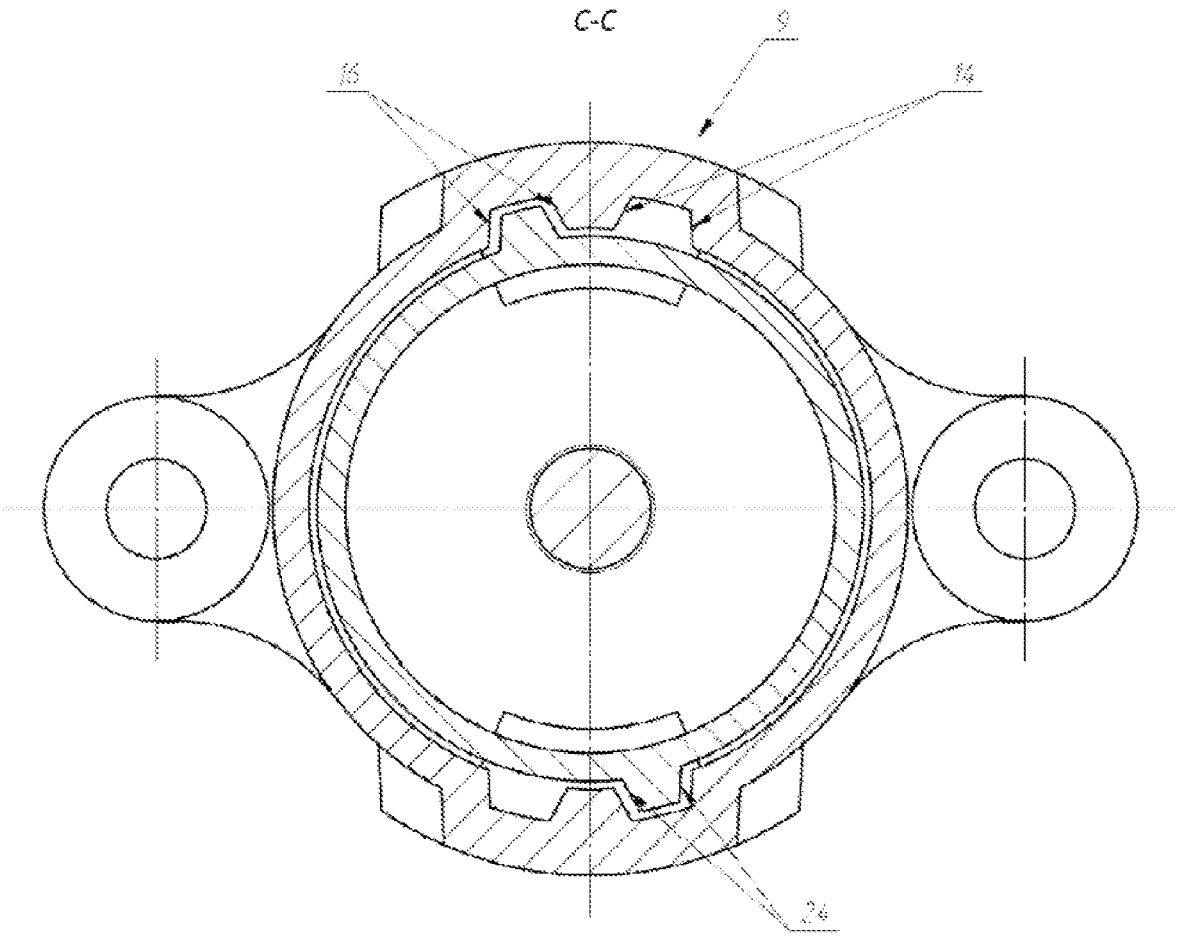
FIG. 4 shows a section taken along line C-C in FIG. 1.
Figure 5:
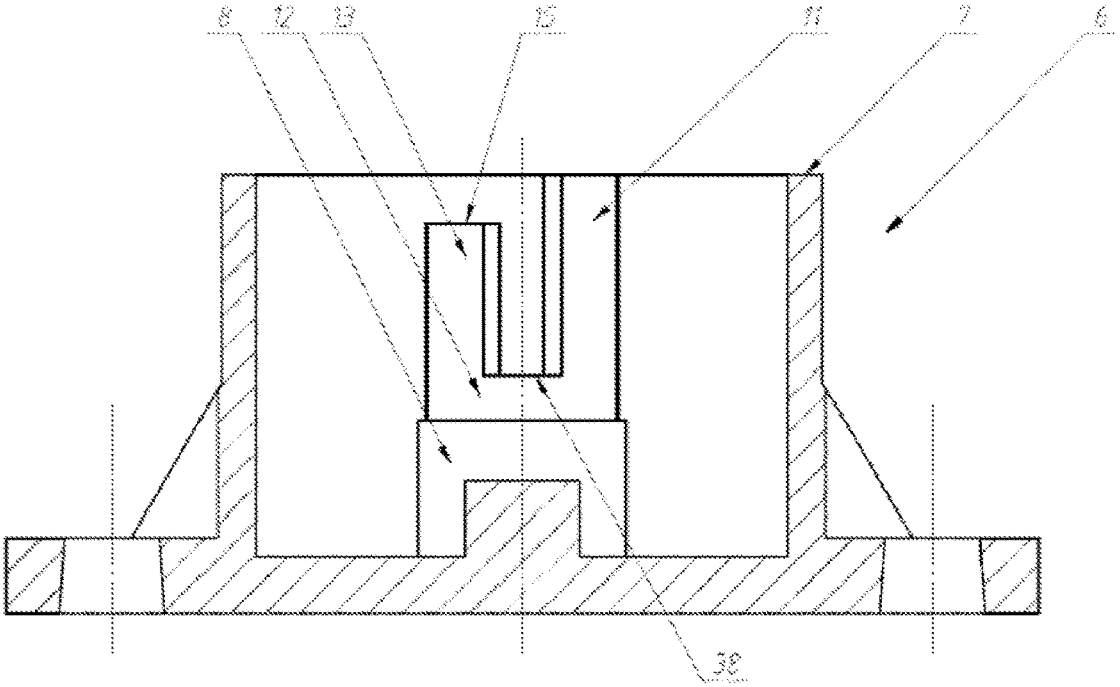
FIG. 5 shows a sectional view of a housing of the side bearing.
Figure 6:
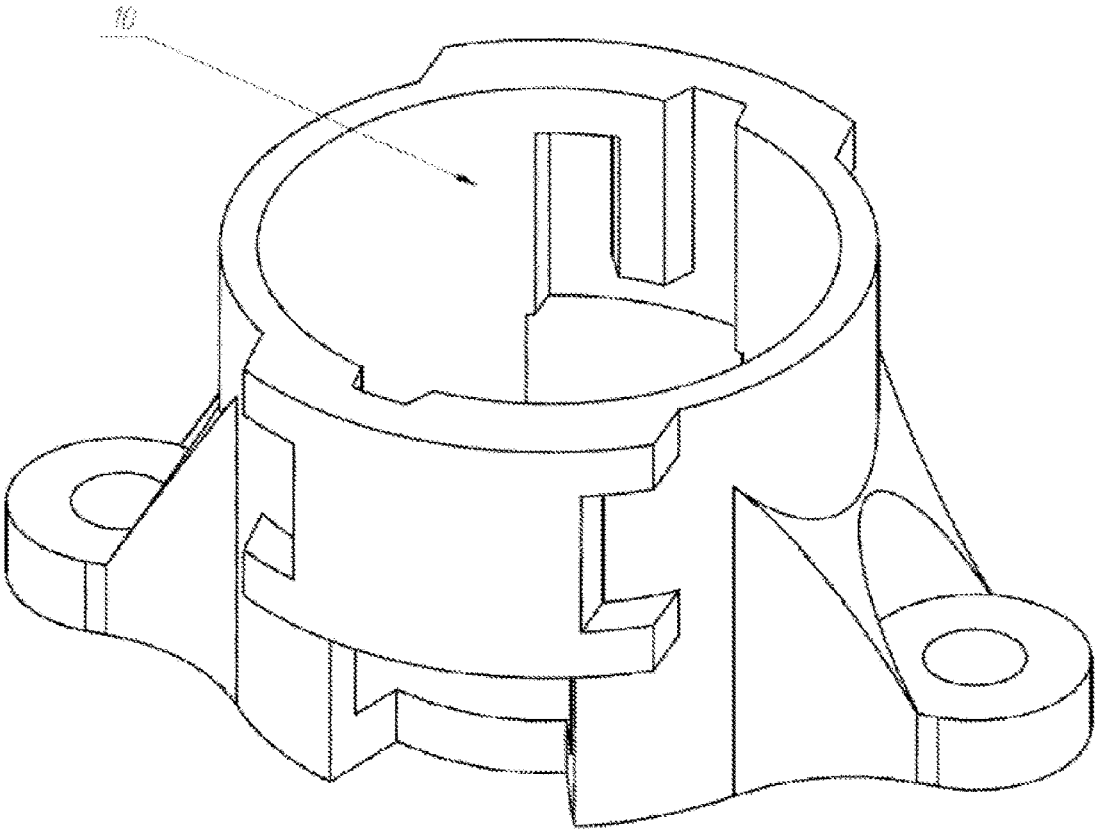
FIG. 6 shows the housing of the side bearing.
Figure 7:
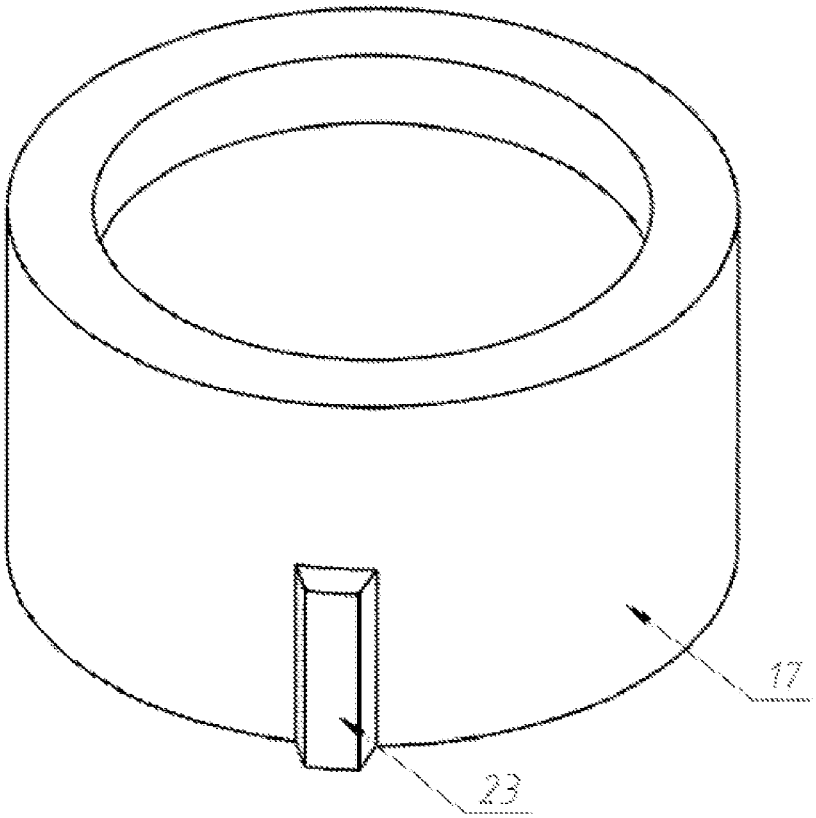
FIG. 7 shows a plate of the side bearing.

A side bearing comprises a base 1, a plate 2, a cover 3, an elastically deformable elastomeric element 4, and an axis 5.

The base 1 is provided with an annular protrusion 6, an upper surface 7 on the upper part of the annular protrusion 6, a centering protrusion 8, and two lateral protruding parts 9. Each lateral protruding part 9 is provided with one J-shaped recess 10 including a vertical through recess 11, horizontal sectoral recess 12 and one vertical constraining recess 13. The vertical through recess has two vertical constraining surfaces 14. The vertical constraining recess has a stop surface 15 in its upper part and two vertical constraining surfaces 16.

The plate 2 has a cylindrical or conical shape and is provided with an annular protrusion 17 in its lower part, a lower surface 18 and a hole 19 in its upper part. The hole 19 is made with a gap from an inner surface 20 of the annular protrusion 17 of the plate, so that an inner lower horizontal surface 21 is formed between the inner surface 20 of the annular protrusion 17 and the hole 19. The plate 2 is provided on the outer surface 22 of the annular protrusion 17 in the lower part, with at least two guiding protrusions 23 each provided with two vertical constraining surfaces 24 and a stop surface 25 in the upper part of the guiding protrusion 23. Moreover, the plate 2 has a flat upper surface 26 configured to interact with a car body.

The cover 3 is provided with an upper horizontal surface 27, a lower horizontal surface 28, a centering protrusion 29 arranged on the axis 6 and formed on the lower horizontal surface 28, an annular radial protrusion 30, an inner cylindrical surface 31, an outer cylindrical surface 32 on the annular radial protrusion 30, and an upper stop surface 33 on the annular radial protrusion 30.

The elastically deformable elastomeric element 4 is preferably provided with a central through hole 34 on the axis 6 along the direction of its compression, so that the centering protrusion 8 of the base 1 and the centering protrusion 18 of the plate 2 are arranged inside the central hole 34. The elastically deformable elastomeric element 4 is further provided with an upper surface 35 and a lower surface 36 and is arranged in a cavity formed by the base 1 with the annular protrusion 6, the plate 2 with the annular protrusion 17 and the lower horizontal surface 28 of the cover 3 in their working assembly.

The stop surface 25 of each guiding protrusion 23 on the annular protrusion 17 of the plate 2 interacts with the stop surface 15 of the corresponding vertical constraining recess 13 in the lateral protruding portion 9 of the annular protrusion 6 of the base 1. There is a technological gap between the vertical constraining surfaces 24 of each guiding protrusion 23 on the annular protrusion 17 of the plate 2 and the vertical constraining surfaces 16 of the corresponding vertical constraining recess 13 in the lateral protruding portion 9 of the annular protrusion 6 of the base 1. When the side bearing is in a complete closure state, an extreme upper point 37 of the guiding protrusion 23 on the annular protrusion 17 of the plate 2 is arranged above an extreme upper point 38 of the horizontal sectoral recess 12, thereby avoiding the possibility of rotating the plate 2 relative to the base 1 and spontaneously disassembling the side bearing.

In a preferred embodiment, the annular protrusion 17 of the plate 2 is arranged inside the annular protrusion 6 of the base 1.

In a preferred embodiment, the cover 3 is arranged inside the plate 2 with the annular protrusion 17 so that the lower horizontal surface 21 of the plate 2 is in contact with the upper stop surface 33 of the annular radial protrusion 30 of the cover 3. There is a technological gap between the outer cylindrical surface 32 of the annular radial protrusion 30 of the cover 3 and the annular protrusion 17 of the plate 2. There is a technological gap between the inner cylindrical surface 31 of the cover 3 and the hole 19 of the plate 2, the gap substantially providing the rotation of the cover 3 relative to the plate 2, thereby resulting in more uniform wear of the upper horizontal surface 27 of the cover 3 that is in contact with the car body and, consequently, increasing the lifespan of the side bearing.

INDUSTRIAL APPLICABILITY

The sequence of assembling the side bearing is as follows.

The elastically deformable elastomeric element 4 is installed in the cavity formed by the base 1 and the annular protrusion 6. Then, the cover 3 is installed, whereafter the plate 2 is installed such that the annular protrusion 17 of the plate 2 is arranged inside the annular protrusion 6 of the base 1. The cover 3 is arranged inside the plate 2 with the annular protrusion 17 such that the lower horizontal surface 21 of the plate 2 is in contact with the upper stop surface 33 of the annular radial protrusion 30 of the cover 3. The technological gap is provided between the outer cylindrical surface 32 of the annular radial protrusion 30 of the cover 3 and the annular protrusion 17 of the plate 2. Being provided between the inner cylindrical surface 31 of the cover 3 and the hole 19 of the plate 2, the technological gap substantially provides the rotation of the cover 3 relative to the plate 2. Further, the elastically deformable elastomeric element 4 is pressed by applying an external load via the plate 2 and the cover 3 onto the heat insulator 5 such that the guiding protrusions 23 move inside the vertical constraining recess of the "T"-shaped recess 10 to the position at which the extreme upper point 37 of the guiding protrusion 23 on the annular protrusion 17 of the plate 2 is arranged below the extreme upper point 38 of the horizontal sectoral recess 12. The flat upper surface 26 of the plate 2 and the upper horizontal surface 27 of cover 3 are arranged below the upper surface 7 of the annular protrusion 6 of the base 1. Next, the plate 2 with the annular protrusion 17 is rotated around the axis 5 relative to the base 1 with the annular protrusion 6 to the position where the guiding protrusions 23 on the annular protrusion 17 of the plate 2 are inside the vertical constraining recesses 15. After that, the external load is removed from the cover 3 and plate 2. The plate 2, the cover 3, and the elastically deformable elastomeric element 4 move to the extreme working position, while the stop surface 25 of each guiding protrusion 23 on the annular protrusion 17 of the plate 2 interacts with the stop surface 15 of the corresponding vertical constraining recess 13 in the lateral protruding part 9 of the annular protrusion 6 of the base 1. The technological gap is provided between the vertical constraining surfaces 24 of each guiding protrusion 23 on the annular protrusion 17 of the plate 2 and the vertical constraining surfaces 16 of the corresponding vertical constraining recess 13 in the lateral protruding portion 9 of the annular protrusion 6 of the base 1.

The side bearing operates as follows.

When a dynamic load is applied to the cover 3, the force is transmitted to the elastically deformable elastomeric element 4, which is installed in the cavity without the possibility of axial displacement and has contact with the cover 3 and the base 1. The annular protrusion 17 of the plate 2 moves along the axis 6 due to the fact that the guiding protrusions 23 move inside the vertical constraining recess 13, the J-shaped recess 10 such that the extreme upper point 37 of the guiding protrusion 23 on the annular protrusion 17 of the plate 2 is arranged, during the operation of the side bearing, above the upper extreme point 38 of the horizontal sectoral recess 12 of the lateral protruding part 9 of the annular protrusion 6 of the base 1. The technological gap is provided between the vertical constraining surfaces 24 of each guiding protrusion 23 on the annular protrusion 17 of the plate 2 and the vertical constraining surfaces 16 of the corresponding vertical constraining recess 13 in the lateral protruding part 9 of the annular protrusion 6 of the base 1. The elastically deformable elastomeric element 4 is centered on the axis by arranging the centering protrusion 29 of the cover 3 and the centering protrusion 8 of the base 1 in the central through hole 34 of the elastically deformable elastomeric element 4. In this case, the cover 3 is arranged inside the plate 2 with the annular protrusion 17 such that the lower horizontal surface 21 of the plate 2 is in contact with the upper stop surface 33 of the annular radial protrusion 30 of the cover 3. The technological gap is provided between the outer cylindrical surface 32 and the annular protrusion 17 of the plate 2. Being provided between the inner cylindrical surface 31 of the cover 3 and the hole 19 of the plate 2, the technological gap substantially provides the rotation of the cover 3 relative to the plate 2, thereby resulting in more uniform wear of the upper horizontal surface 27 of the cover 3.

The invention claimed is:

1. A side bearing comprising:

a base having an annular protrusion, a centering protrusion and two lateral protruding parts;

a plate arranged above the base and having an annular protrusion, the plate being telescopically connected to the annular protrusion of the base and having a hole in an upper part of the plate, the hole being made with a gap from an inner surface of the annular protrusion of the plate;

a cover having a cylindrical or conical shape, the cover having a flat upper surface to interact with a car body, an annular protrusion in a lower part and a centering protrusion on a flat lower surface, the cover being arranged inside the plate with the annular protrusion such that an inner lower horizontal surface of the plate is in contact with the upper surface of the annular radial protrusion of the cover;

an elastically deformable elastomeric element arranged in a cavity formed by the base with the annular protrusion, the plate with the annular protrusion and the cover in their working assembly, and provided with a central through hole provided along a direction of its compression;

wherein the centering protrusion of the base and the centering protrusion of the cover are arranged in the central through hole of the elastically deformable elastomeric element;

each lateral protruding part of the annular protrusion of the base is provided with one J-shaped recess including a vertical through recess, a horizontal sectoral recess and a vertical constraining recess, the vertical through recess having two vertical constraining surfaces, the vertical constraining recess having a stop surface in the upper part and two vertical constraining surfaces;

the plate is provided on the outer surface of the annular protrusion in the lower part and has two guiding protrusions, each of which is provided with two vertical constraining surfaces and a stop surface in the upper part, the stop surface of each of the guiding protrusions on the annular protrusion of the plate interacting with the stop surface of the corresponding vertical constraining recess in the annular protrusion of the base;

there is a technological gap between the vertical constraining surfaces of each of the guiding protrusions on the annular protrusion of the plate and the vertical constraining surfaces of the corresponding vertical constraining recess in the annular protrusion of the base;

when the side bearing is in a complete closure state, an extreme upper point of the guiding protrusion on the annular protrusion of the plate is arranged above an extreme upper point of the horizontal sectoral recess, thereby eliminating the possibility of rotating the plate relative to the base and preventing the side bearing from being spontaneously disassembled.

* * * * *